US005556693A

United States Patent [19]

Yamane et al.

[11] Patent Number: 5,556,693

[45] Date of Patent: * Sep. 17, 1996

[54] IMAGE-RETRANSFERABLE SHEET FOR A DRY IMAGE-TRANSFERRING MATERIAL

[75] Inventors: Mitsuo Yamane, Yokkaichi; Takashi Kawaguchi, Aichi-ken, both of Japan

[73] Assignee: Brother Kogyo Kabushiki Kaisha, Aichi-ken, Japan

[ * ] Notice: The term of this patent shall not extend beyond the expiration date of Pat. No. 5,298,308.

[21] Appl. No.: 488,451

[22] Filed: Jun. 7, 1995

Related U.S. Application Data

[63] Continuation of Ser. No. 253,323, Jun. 3, 1994, abandoned, which is a continuation of Ser. No. 617,356, Nov. 23, 1990, abandoned.

[30] Foreign Application Priority Data

| | | | |
|---|---|---|---|
| Dec. 6, 1989 | [JP] | Japan | 1-318535 |
| Dec. 6, 1989 | [JP] | Japan | 1-318539 |
| Dec. 25, 1989 | [JP] | Japan | 1-335494 |
| Feb. 13, 1990 | [JP] | Japan | 2-33261 |

[51] Int. Cl.[6] ..... B41M 5/00

[52] U.S. Cl. ..... 428/195; 156/235; 428/484; 428/913; 428/914

[58] Field of Search ..... 428/195, 202, 428/207, 484, 488.1, 488.4, 500, 520, 913, 914; 156/235

[56] References Cited

U.S. PATENT DOCUMENTS

| | | | |
|---|---|---|---|
| 4,555,436 | 11/1985 | Geurtsen et al. | 428/914 |
| 4,778,729 | 10/1988 | Mizobuchi | 428/484 |
| 4,927,278 | 5/1990 | Kuzuya et al. | 156/387 |
| 5,006,502 | 4/1991 | Fujimura et al. | 503/227 |
| 5,106,676 | 4/1992 | Sato et al. | 428/195 |
| 5,298,308 | 3/1994 | Yamane et al. | 428/195 |

*Primary Examiner*—Pamela R. Schwartz
*Attorney, Agent, or Firm*—Oliff & Berridge

[57] ABSTRACT

An image-retransferable sheet for dry image-transferring materials produced by heat-sensitive transfer is disclosed, which comprises a substrate having on one surface thereof a layer of surface treating agent, the layer having a tensile strength of from 1 to 100 kg/cm$^2$.

10 Claims, 1 Drawing Sheet

IMAGE-RETRANSFERABLE SHEET FOR A DRY IMAGE-TRANSFERRING MATERIAL

This is a continuation of application Ser. No. 08/253,323 filed Jun. 3, 1994, now abandoned, which in turn is a continuation of Ser. No. 07/617,356 filed Nov. 23, 1990, now abandoned.

BACKGROUND OF THE INVENTION

The present invention relates to an image-retransferable sheet for a dry image-transferring material capable of transferring an image such as letters, signs, figures or the like onto the surface of a desired substance by applying pressure to the image-transferring material whose image-bearing surface is brought into contact with the surface of the substance (hereafter referred to as "pressure-sensitive retransfer"). More specifically, it relates to an image-retransferable sheet of such a dry image-transferring material produced by thermally printing or transferring an image on the sheet with a thermally transferring type printing device such as a printer, a typewriter, a word processor or the like (hereafter referred to as "heat-sensitive transfer").

As base sheet (image-retransferable sheets) for dry image-transferring materials produced by heat-sensitive transfer, Japanese Patent Application No. sho-61-275537 discloses films of polyethylene, polypropylene, fluorine-containing resins, etc., or silicone resin-coated sheets of paper, metal foils, plastic films, etc., which have a smooth surface and exhibit a water-contact angle of at least 95 degree and preferably at least 105 degree.

In formation of an ink image on such a base sheet having a water-contact angle of 95 degree or more by heat-sensitive transfer, an ink temperature is necessarily increased to reduce surface tension of the ink and wet the surface of the base sheet to an extent that adhesion of the ink to the base sheet becomes larger than cohesive force of the ink and adhesion of the ink to an ink-donating base film such as PET. Thus, a high thermal energy is required for the image formation, and it is very disadvantageous to heat-sensitive transferring devices concerning durability of a thermal head and load to an electric source.

Further, ink images formed on such a surface of poor wettability are easily retansferred merely with little pressure applied thereto because of its poor adhesion to the surface so that, upon retransfer of certain portions of the images, the other portions of the images are undesirably retransferred and stain the intended images. Mere touch often removes images from the surface of poor wettability.

Furthermore, when the base sheet having a thermally transferred ink image is subjected to pressure-sensitive retransfer, the sheet is not easily fixed on an image-receiving substance since it has an extremely small coefficient of static friction, resulting in retransfer of imperfect images getting out of position or with distortion.

In order to prevent the base sheet from slipping, it is described in Japanese Patent Application No. sho-62-80127 to provide a sticky layer apart from thermally transferred images on the base sheet. However, an additional means required to provide such a sticky layer at predetermined portions of the base sheet, and a device for the above purpose is needed. Further, the sticky layer has to be covered with a separable sheet, etc. before use, requiring further additional means and costs. In the case of using a silicone resin-coated sheets as a base sheet as described above, two layers, i.e., the silicone resin layer and the sticky layer must be provided and it may well be that one of the two layers previously coated has influence on the other. That is, when a silicone resin is first coated on a sheet, a sticky material is repelled when coated on the silicone resin layer. When the sticky material is first coated at portions of a sheet, its stickiness makes it difficult to coat the silicone resin on the sheet. Even if a separable sheet is provided on the sticky layer, difficulty in coating of the silicone resin cannot be eased because of the increased thickness at the sticky layer-formed portions. Even with the two layers properly coated, fixation of the sheet is yet insufficient as the sticky layer exists only in portions not fully surrounding areas to which thermally transferred images are provided.

In any case, a surface treating agent like a silicone resin coated on a conventional base sheet is not transferred with an ink image but left as it is, and it functions to ensure improved releasability of the ink image from the sheet. Therefore, the surface treating agent has hitherto been selected or formulated to have the property of reducing wettability of the sheet and decreasing adhesion of the ink image to the sheet, which property, however, deteriorates the image-receiving property and image-rubbing resistance of the sheet and necessitate a high thermal energy.

In heat-sensitive transfer, a white paper or the like are generally used as a sheet to which an ink is thermally transferred. In the case, a large hiding power of images (such as letters, figures, etc.) is not required, and white-color images are not generally formed on the image-receiving substances. On the other hand, a large hiding power is sometimes needed in the aforesaid dry image-transferring system since various kinds of materials having various colors are contemplated as an image-receiving substance. In general, color images (e.g., white-color images) other than black images do not possess a large hiding power and often meet with difficulty in confirming the completion of retransfer on the image-receiving substances.

SUMMARY OF THE INVENTION

The first object of the present invention is to provide an image-retransferable sheet which can be easily fixed upon pressure-sensitive retransfer.

The second object of the present invention is to provide an image-retransferable sheet capable of retaining an ink image thereon even when rubbed slightly or applied low pressure, i.e., having good image-rubbing resistance.

The third object of the present invention is to provide an image-retransferable sheet capable of being thermally transferred (printed) an image with good image quality merely by application of low thermal energy.

The fourth object of the present invention is to provide an image-retransferable sheet capable of completely retransferring a thermally transferred image onto an image-receiving substance with no residual ink on the sheet.

The fifth object of the present invention is to provide an image-retransferable sheet which makes it easy to confirm whether a thermally transferred image on the sheet has been retransferred to an image-receiving substance.

The sixth object of the present invention is to provide an image-retransferable sheet capable of forming an image having improved rubbing resistance on an image-receiving substance by pressure-sensitive retransfer.

These objects of the present invention has been attained by an image-retransferable sheet comprising a substrate having on one surface thereof a layer of surface treating agent, the layer having a tensile strength of from 1 to 100 kg/cm$^2$.

DETAILED DESCRIPTION OF THE INVENTION

Figure 1:
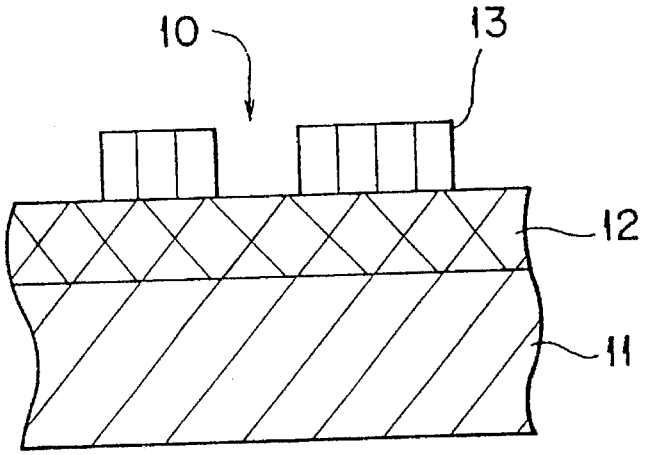
FIGS. 1 and 2 each illustrates a sectional view of an image-retransferable sheet of the present invention; wherein 10 is an image-retransferable sheet having an ink image formed thereon (i.e., a dry image-transferring material), 11 is a substrate, 12 is a layer of surface treating agent, 13 is an ink image, and 14 is a release layer.

As shown in FIG. 1, the image-retransferable sheet of the present invention basically comprises substrate 11 having a layer of surface treating agent 12 (hereafter referred to as "surface treating layer") on one surface thereof.

The substrate which can be used in the present invention generally has a thickness of from 25 to 200 microns and preferably from 50 to 150 microns. It is desired that the substrate possesses not only sufficient mechanical strength for production of the sheet but also flexibility to an extent that pressure can be easily applied to an image-bearing surface of the sheet upon pressure-sensitive retransfer and also that heat-sensitive transfer can be easily effected on the sheet to produce a dry image-transferring material. Substrates having a large elongation are not preferred because they are elongated by the applied pressure upon pressure-sensitive retransfer, resulting in distortion of a retransferred image on an image-receiving substance. In this regard, the elongation is preferably not more than 200%.

To ensure perfect retransfer of an image by pressure-sensitive retransfer, the substrate is preferably transparent or semitransparent. In particular, semitransparent substrates are preferred since it is easy to check whether the image has completely been retransferred or not.

As a substrate, there may be used plastic films, paper, metal foils and the like. Examples of plastic films include films of polyethylene, polypropylene, fluorine-containing resins such as ethylene-tetrafluoroethylene copolymer and tetrafluoroethylene-hexafluoroethylene copolymer, polyethylene terephthalate, nylon, polyimide, polyvinyl chloride, polycarbonate, polysulfone, ethylene-vinyl acetate copolymer, acrylonitrile-butadiene-styrene copolymer, ionomers the like.

Surface treating layer 12 which is coated on a surface of substrate 11 has a tensile strength of from 1 to 100 kg/cm$^2$ and has a thickness of from 1 micron to 20 microns, preferably from 1 micron to 10 microns, so that a thermally transferred image formed on the image-retransferable sheet can be retransferred together with the underlying surface treating agent from the sheet to an image-receiving substance. If the tensile strength exceeds 100 kg/cm$^2$, the resulting surface treating layer exhibits too high cohesive force to be transferred. If it is less than 1 kg/cm$^2$, the layer strength is so small that the resulting layer is peeled off when the sheet is bent.

The surface treating agent preferably has a melting point or softening point of at least 100 degree C. and a melt viscosity at 100 degree C. of at least 1000 poises. Use of a surface treating agent which has a melting point of less than 100 degree C. or becomes too soft at that temperature causes failure in retransfer of a transferred image since the surface treating agent melt upon formation of the transferred image by heat-sensitive transfer.

With a surface treating layer having the tensile strength and melting point (or softening point) within the ranges as described above, an ink image which is formed on the layer by heat-sensitive transfer can be retransferred together with the surface treating agent. Thus, there is no particular limit on wettability of the surface treating layer. Therefore, a thermally transferred image can be formed on the layer with a low thermal energy, adhesion of the transferred image to the layer can be enhanced to improve the image-rubbing resistance of an image-retransferable sheet, and the coefficient of static friction of an image-retransferable sheet can be increased to prevent from being moved during pressure-sensitive retransfer, providing a retransferred image having good image quality on an image-receiving substance with ease.

Retransfer of a thermally transferred ink image together with the underlying surface treating agent provides further advantages. That is, the thermally transferred ink image can be completely retransferred without residual ink, it is easy to confirm completion of retransfer, and the retransferred image has high rubbing resistance as the surface treating agent on the image acts as a protective layer therefor.

Hitherto, a large image has been produced using a heat-sensitive transferring device having a small-serial thermal head by repeating heat-sensitive transfer of the large image line-by-line. Thus, a large image is formed by piecemeal. However, since each run of transfer has to be overlapped in parts of processed areas with a previous run, a previously transferred portion is often rubbed and removed upon the subsequent run. In order to avoid the undesired removal of the portions, heat-sensitive transfer is performed line-by-line to form on an image-retransferable sheet a large image divided into lines with leaving space between lines. In pressure-sensitive retransfer, such a divided large image is retransferred line-by-line on an image-receiving substance in such a manner that the lines are united one after another. According to the present invention, however, such a complicated process can be omitted. Since the image-retransferable sheet of the present invention has relatively high adhesion, a previously transferred portion is not removed by a subsequent run of heat-sensitive transfer and a large image can be formed on the sheet without leaving space between lines.

Examples of surface treating agents used in the present invention include resins such as polyethylene, ethylene-vinyl acetate copolymer, vinyl chloride-vinyl acetate copolymer, polyvinyl butyral, celluloses, ethylene-ethyl acrylate copolymer, ethylene-acrylic acid copolymer, ionomers, ethylene-methacrylic acid copolymer, polyvinyl alcohol, polyvinyl pyrrolidone and silicone, and wax such as polyethylene wax, montan wax, Fischer-Tropsch wax and synthetic wax. They may be used independently or as a mixture of two or more. An amount of wax is preferably of from 40% to 98% by weight.

It is preferred that the surface treating layer contains a wax since use of wax makes it possible to finely control the tensile strength and to expand a range of choice with respect to surface treating agents, improving the retransferring property of the image-retransferable sheet.

In case the surface treating agent mainly comprises the aforesaid resins, the surface treating agent is preferably coated in the form of dispersion such as emulsions and suspension. If it is dissolved in a solvent or melted and coated on the substrate in the form of solution or hot melt, the tensile strength is extremely increased. In order to control the tensile strength or the adhesion of the surface treating layer, a filler may be added to the layer.

By coating the aforesaid surface treating agent on a substrate, an image-retransferable sheet having improved properties can be obtained with respect to heat-sensitive transferring property, pressure-sensitive retransferring property, image-rubbing resistance upon handling, fixability upon pressure-sensitive retransfer and rubbing resistance of a retransferred image, as well as easy confirmation of completed retransfer.

The surface treating layer may contain a colorant such as pigments and dyes. An amount of colorant is of from 1% to 40% by weight, more preferably from 2% to 30%. In the case, the layer provides the same effect as if an ink layer formed thereon became thick. That is, a retransferred image exhibits an increase hiding power even if an image having a low hiding power is retransferred, and this makes the retransferred image more legible.

Figure 2:
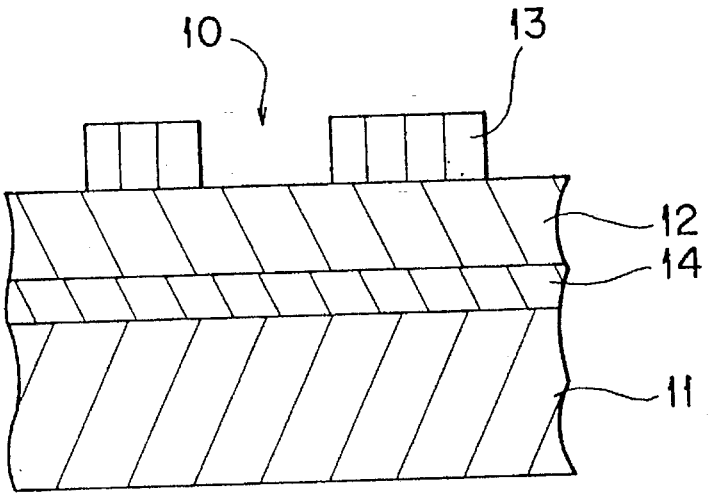

As a preferred embodiment of the present invention, release layer 14 is provided between substrate 11 and surface treating layer 12, as shown in FIG. 2. The thickness of the release layer 14 is substantially 0.1 micron. The release layer not only enables one to use surface treating agents which cannot be used for the reason of high adhesion to the substrate, but in addition markedly improves pressure-sensitive retransferring property of the image-retransferable sheet. The release layer is composed of silicone, fluorine-containing resins, silicone-based resins, a mixture of a fluorine-containing resin and another polymer of acrylic monomer, vinyl acetate, ethylene, etc., or the like.

For formation of transferred images on the image-retransferable sheet of the present invention by heat-sensitive transfer, an ink ribbon used in a conventional thermally printing device can be used, and it comprises an ink layer mainly of wax coated on a film such as PET film. It is preferred that the ink ribbon further comprises a transfer-controlling layer on the ink layer as an overcoat. The transfer-controlling layer has higher heat-sensitive adhesion, hardness, viscosity and cohesive force than the ink layer and the layer markedly improves heat-sensitive transferring property even with an image-retransferable sheet of poor wettability. The transfer-controlling layer is transferred imagewise together with the ink layer by heat-sensitive transfer and is retransferred with the ink image and the surface treating agent upon pressure-sensitive retransfer. It is also preferred to impart pressure-sensitive adhesiveness to the ink layer, whereby pressure-sensitive retransferring property of the resulting dry image-transferring material is further improved.

The present invention is further explained below with reference to the following examples, but the present invention should not be construed as being limited thereto.

EXAMPLE 1

On a polyethylene terephthalate film having a thickness of 50 micron was coated a surface treating agent having the formulation described below, followed by drying at 80 degree C., to obtain an image-retransferable sheet having a smooth surface and having a water-contact angle of 39 degree and a coefficient of static friction of about 0.42. The surface treating agent had a melt viscosity at 150 degree C. of about 2000 to 4000 poises and the layer thereof had a tensile strength of about 20 kg/cm$^2$.

| Formulation of Surface Treating Agent: | parts by weight |
|---|---|
| Polyethylene ("Chemipearl M-200", produced by Mitsui Petrochemical Industries Ltd.) | 80 |
| Titanium oxide ("Taipake A-100", produced by ISHIHARA SANGYO KAISHA) | 20 |

Then, a white ink was thermally transferred imgewise onto the thus prepared image-retransferable sheet using a heat-sensitive transferring type word processor ("P-touch", produced by Brother Industries Co., Ltd.), whereby a dry image-transferring material having a white-color image was obtained. In the heat-sensitive transfer, the image was formed with good image quality by application of a low thermal energy, as compared to the case of using a conventional image-retransferable sheet.

Using the dry image-transferring material, pressure-sensitive retransfer was carried out onto paper and a plastic substance, and as a result, a retransferred white-color image having a high hiding power was formed thereon. During the pressure-sensitive retransfer, the dry image-transferring material could be fixed in situ so that perfect retransfer could be done without any difficulty. Further, the surface treating agent was transferred together with the image, so that it was easy to confirm completion of the retransfer and the retransferred image covered with the surface treating agent exhibited good rubbing resistance.

EXAMPLE 2

Onto a nylon film having a thickness of 100 micron was coated a surface treating agent having the following formulation, followed by drying at 80 degree C., to obtain an image-retransferable sheet having a smooth surface and having a water-contact angle of 76 degree and a coefficient of static friction of about 0.77. The surface treating agent had a melt viscosity at 150 degree C. of about 5000 poises, and the layer thereof had a tensile strength of 15 kg/cm$^2$.

| Formulation of Surface Treating Agent: | parts by weight |
|---|---|
| Ionomer ("Chemipearl SA-100", produced by Mitsui Petrochemical Industries Ltd.) | 80 |
| Azo type organic pigment ("CROMOPHTAL Yellow 3G", produced by Ciba-Geigy) | 20 |

Using the thus prepared image-retransferable sheet, a dry image-transferring material was prepared in the same manner as in Example 1, with which pressure-sensitive retransfer was then carried out. As a result, the retransferred image had good image quality and had a high hiding power due to the added colorant.

EXAMPLE 3

A release agent having the following formulation was coated on a polyethylene terephthalate film having a thickness of 50 micron and cured. On the thus formed release layer was coated a surface treating agent having the formulation also described below, followed by drying at 80 degree C., to obtain an image-retransferable sheet having a smooth surface and having a water-contact angle of 39 degree and a coefficient of static friction of about 0.42. The surface treating agent had a melt viscosity at 150 degree C. of about 2000 to 4000 poises, and the layer thereof had a tensile strength of about 20 kg/cm$^2$.

| Formulation of Release Agent: | parts by weight |
|---|---|
| SIlicone ("KS774", produced by Shin-Etsu Chemical Co., Ltd.) | 97 |
| Curing agent ("PL-4", produced by Shin-Etsu Chemical Co., Ltd.) | 3 |

| Formulation of Surface Treating Agent: | parts by weight |
|---|---|
| Polyethylene ("Chemipearl M-200", produced by Mitsui Petrochemical Industries Ltd.) | 100 |

Using the thus prepared image-retransferable sheet, a dry image-transferring material was prepared by heat-sensitive transfer in the same manner as in Example 1, except that a black ink was thermally transferred instead of the white ink. Then, pressure-sensitive retransfer was carried out using the dry image-transferring material. In the heat-sensitive transfer and the pressure-sensitive retransfer, the same results as in Example 1 were obtained, except that the dry image-transferring material exhibited more improved pressure-sensitive transferring property, as compared to that of Example 1, due to the release layer reducing the adhesion between the surface treating layer and the substrate.

EXAMPLE 4

A release agent having the following formulation was coated on a nylon film having a thickness of 100 micron and cured. On the thus formed release layer was coated a surface treating agent having the formulation also described below, followed by drying at 80 degree C., to obtain an image-retransferable sheet having a smooth surface and having a water-contact angle of 76 degree and a coefficient of static friction of about 0.77. The surface treating agent had a melt viscosity at 150 degree C. of about 5000 poises, and the layer thereof had a tensile strength of about 15 kg/cm$^2$.

| Formulation of Release Agent: | parts by weight |
|---|---|
| Silicone ("KS841", produced by Shin-Etsu Chemical Co., Ltd.) | 97 |
| Curing agent ("PL-8", produced by Shin-Etsu Chemical Co., Ltd.) | 3 |

| Formulation of Surface Treating Agent: | parts by weight |
|---|---|
| Ionomer ("Chemipearl SA-100", produced by Mitsui Petrochemical Industries Ltd.) | 100 |

Using the thus prepared image-retransferable sheet, a dry image-transferring material was prepared by heat-sensitive transfer in the same manner as in Example 3, and pressure-sensitive retransfer was carried out using the material. As a result, a retransferred image having good image quality was formed on an image-receiving substance.

EXAMPLE 5

The same procedure as in Example 3 was repeated except using the surface treating agent having the following formulation, whereby an image-retransferable sheet having a smooth surface and having a water-contact angle of 39 degree and a coefficient of static friction of about 0.42 was obtained. The surface treating agent had a melt viscosity at 150 degree C. of about 2000 to 4000 poises, and the layer thereof had a tensile strength of about 20 kg/cm$^2$.

| Formulation of Surface Treating Agent: | parts by weight |
|---|---|
| Polyethylene ("Chemipearl M-200", produced by Mitsui Petrochemical Industries Ltd.) | 80 |
| Titanium oxide ("Taipake A-100", produced by ISHIHARA SANGYO KAISHA) | 20 |

Then, a white ink was thermally transferred imgewise onto the thus prepared image-retransferable sheet using a heat-sensitive transferring type word processor ("P-touch") as in Example 1, whereby a dry image-transferring material having a white-color image was obtained. In the heat-sensitive transfer, the image was formed with good image quality by application of a low thermal energy, as compared to the case of using a conventional image-retransferable sheet.

Using the dry image-transferring material, pressure-sensitive retransfer was carried out in the same manner as in Example 3. In the pressure-sensitive retransfer, the same results as in Example 3 were obtained, except that a retransferred white-color image having a sufficiently high hiding power was formed on an image-receiving substance.

EXAMPLE 6

The same procedure as in Example 4 was repeated except using the surface treating agent having the following formulation, whereby an image-retransferable sheet having a smooth surface and having a water-contact angle of 76 degree and a coefficient of static friction of about 0.77 was obtained. The surface treating agent had a melt viscosity at 150 degree C. of about 5000 poises, and the layer thereof had a tensile strength of about 15 kg/cm$^2$.

| Formulation of Surface Treating Agent: | parts by weight |
|---|---|
| Ionomer ("Chemipearl SA-100", produced by Mitsui Petrochemical Industries Ltd.) | 80 |
| Azo type organic pigment ("CROMOPHTAL Yellow 3G", produced by Ciba-Geigy) | 20 |

Using the thus obtained image-retransferable sheet, a dry image-transferring material was prepared in the same manner as in Example 5, and pressure-sensitive retransfer was carried out using the material. As a result, a retransferred image having a sufficiently high hiding power was formed with good image quality on an image-receiving substance.

EXAMPLE 7

The same procedure as in Example 3 was repeated except using the surface treating agent having the following formulation, whereby an image-retransferable sheet having a smooth surface was obtained. The surface treating agent had a melting point of about 120 degree C., and the layer thereof had a tensile strength of about 20 kg/cm$^2$.

| Formulation of Surface Treating Agent: | parts by weight |
|---|---|
| Polyethylene wax ("Chemipearl W-100", produced by Mitsui Petrochemical Industries Ltd.) | 90 |
| Ethylene-vinyl acetate copolymer ("Chemipearl V-300", produced by Mitusi Petrochemical Industries Ltd.) | 10 |

Then, a black ink was thermally transferred imgewise onto the thus prepared image-retransferable sheet using a heat-sensitive transferring type word processor ("P-touch") as in Example 1, whereby a dry image-transferring material having a black-color image was obtained. In the heat-sensitive transfer, the image was formed with good image quality by application of a low thermal energy, as compared to the case of using a conventional image-retransferable sheet.

Using the dry image-transferring material, pressure-sensitive retransfer was carried out in the same manner as in Example 3. In the pressure-sensitive retransfer, the same results as in Example 3 were obtained.

EXAMPLE 8

The same procedure as in Example 4 was repeated except using the surface treating agent having the following formulation, whereby an image-retransferable sheet having a smooth surface was obtained. The surface treating agent had a melting point of about 109 degree C., and the layer thereof had a tensile strength of about 10 kg/cm$^2$.

| Formulation of Surface Treating Agent: | parts by weight |
|---|---|
| Polyethylene wax ("Mitusi Hiwax 110P", produced by Mitsui Petrochemical Industries Ltd.) | 10 |
| Toluene | 90 |

Using the thus obtained image-retransferable sheet, a dry image-transferring material was prepared in the same manner as in Example 7, and pressure-sensitive retransfer was carried out using the material. As a result, a retransferred image having good image quality was formed on an image-receiving substance.

While the present invention has been described in detail and with reference to specific embodiments thereof, it will be apparent to one skilled in the art that various changes and modifications can be made therein without departing from the spirit and scope thereof.

What is claimed is:

1. An image-retransferable sheet for retransferring an ink image, transferred thereon through a heat-sensitive transfer process, onto a desired image receiving material through a pressure-sensitive transfer process, the image-retransferable sheet comprising:

a substrate having a first surface and a second surface opposite to the first surface;

a layer of a surface treating agent formed on the first surface of said substrate, said layer having a thickness in a range of 1 to 20 μm and having an exposed surface not adjacent the substrate, said layer having a tensile strength of from 1 to 100 kg/cm$^2$, said surface treating agent having at least one of a melting point of at least 100° C., a softening point of at least 100° C., and a melt viscosity at 100° C. of at least 1000 poises; and an ink image on the exposed surface of said layer of the surface treating agent formed on said substrate, said ink image being transferred through a heat-sensitive transfer process onto the exposed surface of said layer, whereby the ink image is retransferred onto a desired image receiving material together with the surface treating agent, the surface treating agent having the ink image received thereon being removed from the first surface of said substrate by application of pressure to the second surface of said substrate in a pressure-sensitive transfer process, so that the surface treating agent covers said ink image retransferred on the image receiving material.

2. An image-retransferable sheet as claimed in claim 1, wherein said surface treating agent layer has a thickness in a range of 1 to 10 μm.

3. An image-retransferable sheet as in claim 1, wherein said surface treating agent layer contains wax.

4. An image-retransferable sheet of claim 1, wherein substantially the entire portion of said layer of the surface treating agent which underlies the ink image is removed from the first surface of said substrate together with the ink image located thereon during the pressure-sensitive transfer process, the removed surface treating agent covering the ink image retransferred on the desired image receiving material.

5. An image-retransferable sheet as in claim 1, wherein said layer of surface treating agent contains a colorant.

6. An image-retransferable sheet as in claim 5, wherein a release layer is provided between the substrate and the surface treating agent layer, said release layer promoting the transfer of the surface treating agent toward the desired image receiving material through the pressure-sensitive process.

7. An image-retransferable sheet as in claim 6, wherein said surface treating agent layer contains wax.

8. An image-retransferable sheet as in claim 5, wherein said surface treating agent layer contains wax.

9. An image-retransferable sheet as in claim 1, wherein a release layer is provided between the substrate and the surface treating agent layer, said release layer promoting the transfer of the surface treating agent toward the desired image receiving material through the pressure-sensitive transfer process.

10. An image-retransferable sheet as in claim 9, wherein said surface treating agent layer contains wax.

* * * * *

UNITED STATES PATENT AND TRADEMARK OFFICE

CERTIFICATE OF CORRECTION

PATENT NO. : 5,556,693
DATED : September 17, 1996
INVENTOR(S) : YAMANE et al.

It is certified that error appears in the above-indentified patent and that said Letters Patent is hereby corrected as shown below:

On title page,

In the "Notice:" field, change 5,298,308 to 5,217,793.

Signed and Sealed this

Twenty-ninth Day of April, 1997

*Attest:*

Bruce Lehman

BRUCE LEHMAN

*Attesting Officer*

*Commissioner of Patents and Trademarks*